US005833117A

United States Patent [19]

Kovens et al.

[11] Patent Number: 5,833,117

[45] Date of Patent: Nov. 10, 1998

[54] DYNAMIC VENDING MACHINE WITH TRACK INSERT ASSEMBLY

[75] Inventors: Steven A. Kovens, Owings Mills; Wayne Mincher, Towson; Michael T. Gootee, Baltimore; Robert H. Tegtmeier, Phoenix, all of Md.

[73] Assignee: Parkway Machine Corporation, Timonium, Md.

[21] Appl. No.: 730,144

[22] Filed: Oct. 15, 1996

Related U.S. Application Data

[63] Continuation-in-part of Ser. No. 53,134, Apr. 15, 1996, Pat. No. Des. 387,385.

[51] Int. Cl.[6] ..... A24F 15/04

[52] U.S. Cl. ..... 221/24; 221/155

[58] Field of Search ..... 221/24, 155, 265, 221/196, 195

[56] References Cited

U.S. PATENT DOCUMENTS

| | | | |
|---|---|---|---|
| D. 272,162 | 1/1984 | McPhall | D20/7 |
| D. 314,402 | 2/1991 | Kovens | D20/4 |
| D. 314,794 | 2/1991 | Kovens | D20/4 |
| D. 335,595 | 5/1993 | Bowen | D6/472 |
| D. 344,762 | 3/1994 | Peterson | 194/292 |
| D. 348,160 | 6/1994 | Bustos | D6/470 |
| 2,193,211 | 3/1940 | Taylor | 312/36 |
| 2,772,811 | 12/1956 | Schaef | 221/196 |
| 2,843,985 | 7/1958 | Ritzenberg | 53/235 |
| 3,077,254 | 2/1963 | Goldfarb | 221/155 |
| 4,560,086 | 12/1985 | Stol | 221/24 |
| 5,009,330 | 4/1991 | Young et al. | 221/196 |
| 5,370,391 | 12/1994 | Hilzendeger | 273/118 R |
| 5,452,822 | 9/1995 | Haymond | 221/155 |

OTHER PUBLICATIONS

A&A Company/Parkway Machine Corporation Catalogue, Parkway Machine Corporation (page 10 and 11) since 1941.

A&A Company/Parkway Machine Corporation; Wizard Gumball Machine Brochure—1994.

A&A Company/Parkway Machine Corporation; Zipper Gumball Machine Brochure—Dec. 1995.

Machine–O–Matic Ltd.; Gumball Machine Brochure—Mar. 1996.

*Primary Examiner*—Kenneth Noland
*Attorney, Agent, or Firm*—Cahn & Samuels, LLP.

[57] ABSTRACT

A dynamic bulk vending machine including a merchandise globe assembly sitting on an upper hopper, an intermediate chamber containing a unitary, multi-layer, serpentine, wire-form track defining an irregular pathway for spherical merchandise which sits on a lower hopper, all of which sit on a base containing a coin receiving actuation mechanism which is mechanically linked to both hoppers.

42 Claims, 2 Drawing Sheets

DYNAMIC VENDING MACHINE WITH TRACK INSERT ASSEMBLY

RELATED APPLICATION

This is a continuation-in-part application to U.S. Design patent application Ser. No. 29/053,134 filed Apr. 15, 1996 now U.S. Pat. No. D387,385.

TECHNICAL FIELD

The present invention is directed to improvements on coin-actuated vending machines. More particularly, the invention is directed to coin-actuated bulk vending machines incorporating a serpentine track interposed between the storage globe and a hopper containing base of the machine containing the coin receiving mechanism to provide irregular dynamic movement of dispensed items. The serpentine track provides a visual component to dispensing operations that can serve to confirm product identity or character and, significantly, enhance the entertainment value of the vending process.

BACKGROUND OF THE INVENTION

Coin operated bulk vending machines of the type used to vend candy, nuts, capsules, gum and the like are commonplace. Such devices typically are found in public locations such as stores, taverns, malls, etc. Bulk vending machines typically comprise two primary operational segments; the merchandise storage globe and the base. The merchandise storage globe typically projects above the base and is supported by a nesting relation thereon. The base typically contains a coin mechanism for receiving selected coinage and a merchandise discharge chute/chute cover assembly for dispensing vended goods. Typically, the merchandise stored in the globe, moves under gravity from the globe and into a hopper containing rotatable merchandise wheel seated in and forming part of the hopper. Segmented, discrete chambers characterize the merchandise wheel sized to receive a unit of merchandise and to rotate progressively as the merchandise wheel rotates to communicate with a discharge opening formed at the junction of the wheel and an underlying discharge chute. The merchandise wheel is mechanically linked to the coin mechanism and is rotated by actuation of the coin mechanism.

The coin mechanism receives coins and actuating the discharge of merchandise from the machine. In operation, following introduction of the designated coinage into the coin mechanism, a manual crank handle is rotated 360°. As the handle rotates, it imparts, rotational movement in measured increments (e.g. 60°) to the merchandise wheel that causes the discharge of merchandise to the chute. One such type of coin mechanism is described in U.S. Pat. No. 5,111,928, incorporated herein by reference. Merchandise discharged from the hopper and into the chute descends to the dispensing end of the chute. A pivotal chute cover covers that end typically.

Generally, because the base nests the merchandise wheel directly below the globe, bulk vending machines cannot accommodate visually accessible merchandise dispensing pathways. While certain bulk vending machine designs do contemplate an intermediate chamber placed between the hopper and the merchandise outlet, such designs have shortcomings in respect to cost, labor, space, and maintenance. The prior art includes machines with downwardly spiraling pathways providing visual access to merchandise while being dispensed. However, such machines are stand alone passive units requiring the coin mechanism and merchandise wheel to be adjacently positioned the storage hopper. The machines are standalone units that require substantial dedicated floor area for access to the machine and to provide adequate space to house the discharge chute and coin receiving chamber and to support the intermediate chamber. The intermediate chamber is established, for example, by a spiral pathway within a transparent tubular housing, on which a conventional machine base, storage hopper arrangement is located. Such machines require positioning of the coin receiving crank-type actuation mechanism/merchandise discharge wheel directly below the merchandise storage globe. Such a machine is depicted in U.S. Pat. No. 5,452,822 which is incorporated herein by reference.

As noted, the basic construction of the prior art spiral machines requires the coin receiving and the crank actuation mechanism to be adjacent the storage globe and in the underlying hopper. However, because there is no space for received coin storage, provision for placing a communication channel between the coin mechanism and a coin collection chamber is located in the floor base must be established. Thus, the spiral type of machine necessarily must accommodate a vertical and substantially invasive tubular channel to permit communication of deposited coins from the coin receiving mechanism passage through the entire length of the intermediate chamber and into the floor base. Consequently, the coin communication channel incorporates a vertical, wide diameter opening the limits the amount of space in the intermediate chamber and limit merchandise movement to a spiral movement. Furthermore, assembly of the spiral segments about the coin communication tube involves substantial labor to assemble into a functional uniform system. Accordingly, the spiral, prior art machine structures do not lend themselves readily to combination with machines located on racks containing multiple machines.

While providing some dynamic merchandise movement, the prior art tube structures effectively provide only one type of movement; spiral. Continuous spiral movement is based on a simple motion pattern generated by a combination of gravity and centrifugal force. The discharge of products from the downward spiral provides a degree of dynamic entertainment value which is an improvement over static, point-of-sale, bulk vending from a self-promotion perspective because the entertainment factor can generate continuing interest and, therefore, repeat purchases.

The idea of a compact, visually dynamic, simplified assembly, rack oriented bulk vending machine appears to have escaped the industry. Such a machine would provide desirable advantages of a dynamic machine while also providing location flexibility.

SUMMARY OF THE INVENTION

It is therefore an object of the present invention to provide a dynamic vending machine that overcomes shortcomings and problems of the prior art.

It is another object of the invention to provide an improved coin operated bulk vending machine.

Still another object of the present invention to provide a bulk vending machine having advantages of visually observable and entertaining dynamic movement of discharged merchandise while providing rack system compatibility.

Still another object of the invention is to provide a uniform, unitary, tortuous, observable dispensing track assembly system.

Another object of this invention is to provide, in a coin-actuated machine, a track assembly capable of retrofitting on existing machines.

Still another object of this invention is to provide a track assembly that adapts to the dimensional constraints of conventional vending machine racks.

Yet another object of this invention is to provide a convertible, dynamic discharge track that is capable of accommodating spherical merchandise and/or merchandise encased in spherical containers or capsules of different dimensions.

A final listed object of this invention is to provide a merchandise discharge track that may be conveniently, efficiently, and inexpensively installed or replaced with a minimum of labor.

These and other objects are satisfied by a vending machine, comprising: a merchandise storage globe, a merchandise dispensing control element associated with said storage globe, an intermediate chamber in merchandise communication with said dispensing control element, a separate base including a dispensing opening and a rotatable manipulable crank, a drive shaft linkage extending through said intermediate chamber to said merchandise dispensing control element and drivingly connecting said manipulable crank with said merchandise dispensing control element for controlled dispensing of merchandise from said storage globe to said dispensing opening.

Further objects of the present invention are satisfied by a method of using a vending machine according to the foregoing.

Dynamic bulk vending machines according to this invention utilize easily replaceable, modular geometrically formed track inserts designed to dispense goods by gravity actuation generating adequate momentum to insure that the spherical product is completely dispensed.

This invention also provides a dynamic bulk vending machine structure that minimizes the labor and time required to align the track relative to the overlying and underlying merchandise discharge wheels thus, eliminating criticality of calibration of the insert in conjunction with synchronized merchandise wheels and the discharge chute.

Given the following enabling description of the drawings, the inventive coin operated bulk vending machines incorporating the visually dynamic unitary merchandise discharge path and the scope of the invention should become evident to a person of ordinary skill in the art.

DETAILED DESCRIPTION OF THE PREFERRED EMBODIMENT

Figure 1:
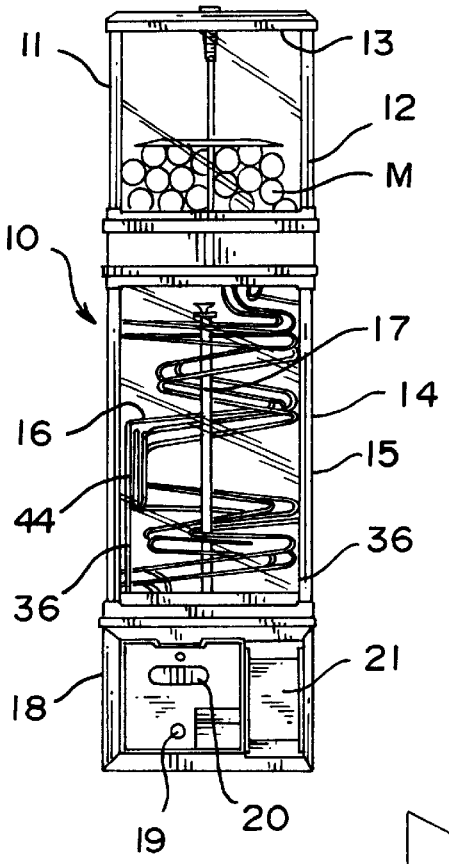
FIG. 1 is a front view of an embodiment of a bulk vending machine according to the invention.

FIG. 1 illustrates a dynamic discharge coin-actuated bulk vending machine according to the present invention. The bulk vending machine 10 features, from the top down, a merchandise globe assembly sitting on an upper hopper, an intermediate chamber containing a wire form track that sits on a lower hopper, all of which sit on a base containing a coin receiving, rotating actuation mechanism which is mechanically linked to both hoppers.

In more detail, the vending machine 10 includes a merchandise globe 11 for storing generally spherical merchandise M. The top of the globe 11 is sealed with a lid 12 which is locked with a barrel lock 13. The middle portion of the bulk vending machine 10 according to this invention, features an intermediate chamber housing 14 containing a wire form track 16. The chamber housing 14 is formed by an enclosure established by framed transparent wall panel members 15. A rotating driver/lock rod assembly 17 projects vertically through the center of the chamber housing 14.

The chamber housing 14 and the track 16 are seatingly mounted on a base 18. A coin receiving mechanism 19, an actuation crank handle 20, and a coin discharge chute 21 are all secured on the front face of the base 18. The coin mechanism is connected in a manner to impart rotational motion from the crank handle 20 to the rotating driver/lock rod assembly 17 for discharge of merchandise.

The basic components and structure of the lid 12, the merchandise container hopper 11 and the base 18 are known in the art and are manufactured and sold by Parkway Machine Corporation in the form of a bulk vending machine under the name Victor 77®. The Victor 77® machine is well known has been used in the bulk vending industry for decades. That machine is well established because of its reliable construction and capability to conform to conventional multi-machine rack arrangements. Other machines meeting such criteria, such as the PN95®or 2001 machines produced by Applicant may be modified to provide the invention herein.

Figure 2:
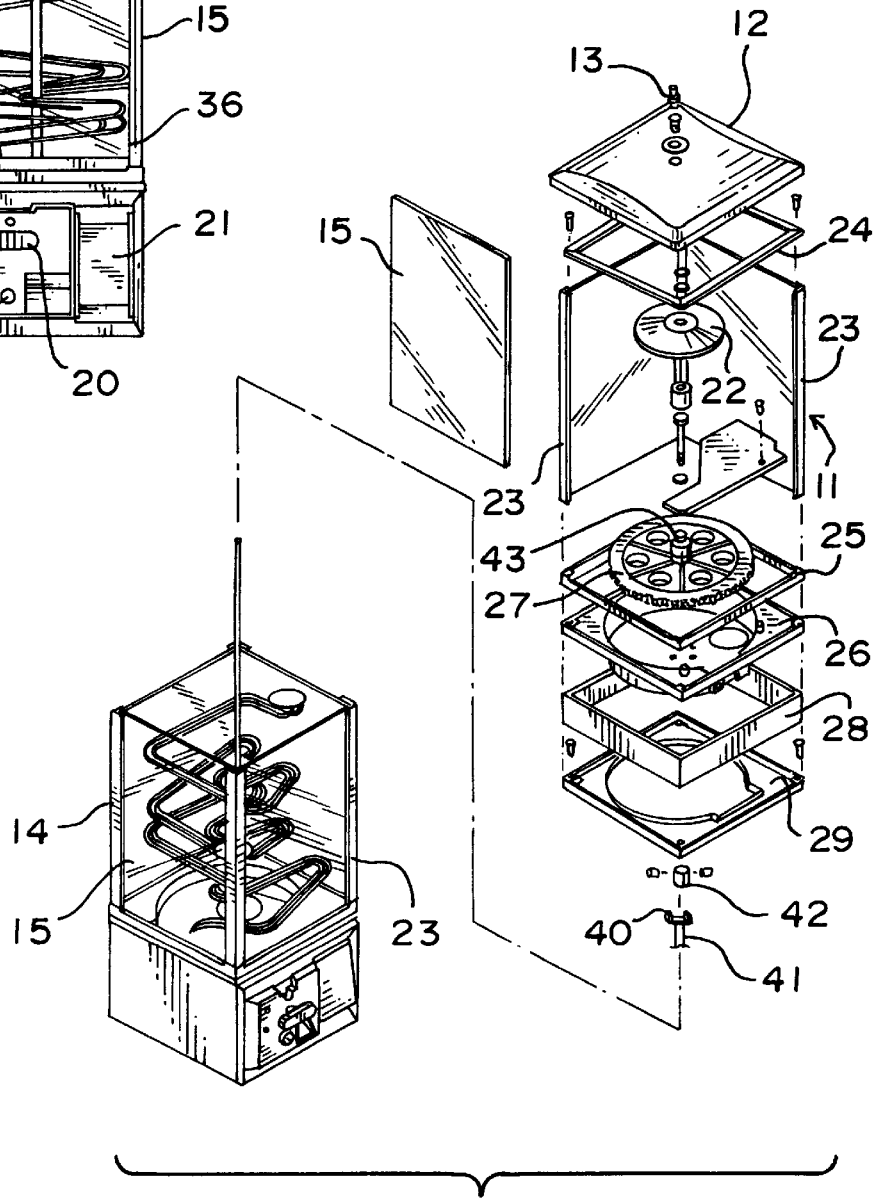
FIG. 2 is a partial exploded, assembly view detailing a panel style merchandise globe of the embodiment illustrated in FIG. 1.

FIG. 2 provides details of the construction of the merchandise globe 11. The upper opening of the globe 11 is lockably sealed by lid 12 and barrel lock 13. The barrel lock 13 rotatably engages the uppermost end of the rotating driver/lock rod assembly 17 that is threaded to clamp the lid 12 onto the square top ring frame member 24 defining the upper edge of the globe 11. A merchandise baffle plate 22 is located on the rod assembly 17 and disposed at a selected height within the globe 11.

While any globe container/assembly structure, can be used in conjunction with the invention, the globe 11 of the illustrated embodiment, is in the form of a panel head assembly. That is, it is formed by four clear rectangular sheets 15 composed of glass or synthetic resin seated in vertical corner post frame members 23 and within square top ring frame member 24 and square ring lower frame member 25. The square ring lower frame member 25 is adapted to cooperatingly sit on the upper hopper portion of the machine.

The merchandise globe 11 sits on an upper hopper 26 in which a merchandise wheel 27 is rotatably seated. The hopper 26 sits on a hopper adapter 28 that, in turn sits on a hopper adapter 29. The hopper structure is of a conventional nature in bulk vending and functions to communicate one item of merchandise from the globe, into the wheel, around the hopper for discharge through an aperture formed in the hopper floor.

The ceiling of the intermediate portion 14 of the inventive vending machine is established by the hopper adapter 29 which conforms, in structure and function along its bottom surface, to square ring frame member 24. That is, it acts as the upper frame portion for the panel structure defining the intermediate chamber 14.

Figure 3:
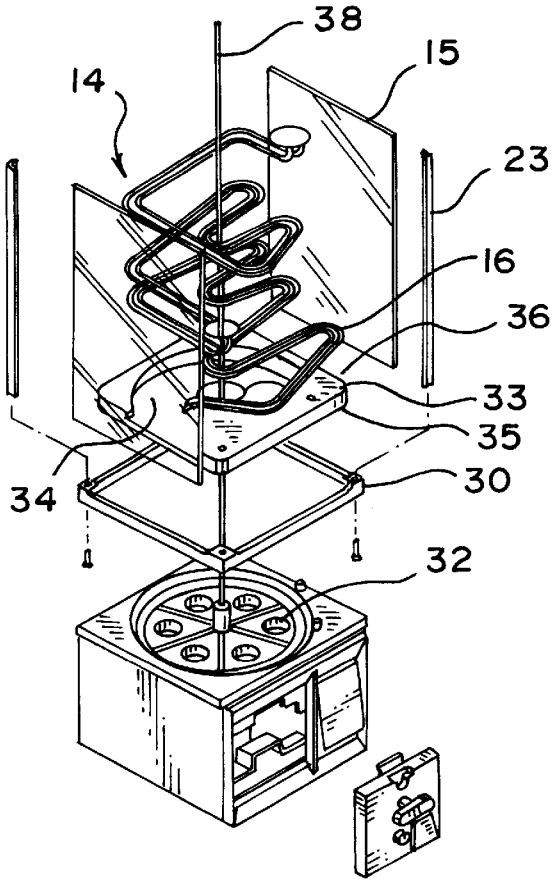
FIG. 3 is a partial exploded, assembly view detailing the intermediate chamber and discharge track of the embodiment illustrated in FIG. 1.

The intermediate chamber 14 is of a panel structure similar to that the panel globe 11 described above. As it is more clearly illustrated in FIG. 3, the intermediate chamber 14 has a cross-sectional dimension substantially the same as the merchandise globe 11 and is established by four clear plastic panels 15 of selected height, framed by four corner posts 23 of corresponding height. The upper and lower edges of the panels are engaged with the lower surface of the square ring member 29 and are nested in the upper square ring member 30 of a lower hopper 31. The lower hopper 31 includes a merchandise wheel 32 having peripheral teeth establishing a planetary gear engagable with the gearing associate with the actuation mechanism. The lower hopper 31 arrangement differs from the upper hopper in that it incorporates a channeled insert deflector 33 formed from a plastic material of sufficient rigidity and strength to provide a merchandise guide channel 34 to direct merchandise from the bottom of the wire form track 16 into the receiving sixth segment of the merchandise wheel 32 with the drop through aperture. Because the deflector sits on the top of the lower hopper 31, which, in turn, is nested in the top of the base 18, the deflector 33 also incorporates elements to stabilize and support the wire-form track 16 in the form of receiving holes 35. These holes are sized to cooperate with and receive vertical members 36 of the wire form track 16.

The base 18, as indicated above, is of conventional construction, and as illustrated in the depicted embodiment, includes a handle 20 directly coupled to the coin mechanism 19. The handle 20 is rotatably coordinated to a coin wheel/sprocket assembly of the coin mechanism 19 which, in turn, are coupled through an output shaft to the planetary gearing of lower merchandise wheel 32. Thus, when a valid coin is inserted into the coin receiving mechanism 19 to permit 360° rotation of crank handle 20, the merchandise wheel is rotated by 60° and through the below-described drive linkage connecting the upper and lower merchandise wheels, merchandise M is discharged from the upper merchandise wheel 27, into wire form track 16, onto deflector plate 33, into the lower merchandise wheel 32, and into a merchandise chute 37 covered at its lower end by pivotal chute cover 21.

The remotely spaced merchandise wheels are rotatably synchronized by rod assembly 17. The rod assembly 17 comprises a center rod 38 that is threaded at both ends to provide lockable compression clamping for the entire machine 10. The upper rod segment of the rod assembly 17, extends vertically through the globe 11 and includes an upper threaded end to cooperatively engage with the barrel lock 13 and to clamp the lid 12 securely on the when seated on the square top ring frame member 24 of the globe 11. The center rod extends through the upper hopper 26, through the intermediate chamber 14, through the lower hopper 31 and the lower threaded end thereof is secured to the carriage bolt/reducer assembly 38 to the floor of the base 18.

As illustrated, the rotational drive assembly established between the crank handle 20 and the upper merchandise wheel 27 includes a series of mechanical linkages. The linkages are established by a notched, keyed coupling lug 39 formed on the upper portion of the lower merchandise wheel 32 which includes a central opening of a diameter sufficient to accommodate the threaded center rod 38 and a toothed spline coupling nut 40 formed on the end of the drive shaft 41. The drive shaft 41 extends through the intermediate chamber 14 and encloses the center rod 38. The upper end of the drive shaft 41 includes a second, toothed splined coupling nut interlocked directly with a notched, keyed coupling lug 39 formed on the lower portion of the upper merchandise wheel 27. Alternatively, to permit use of identical merchandise wheels, the drive shaft may be linked to a notched, keyed coupling lug formed on the upper portion of the upper merchandise wheel 27 by using a double key coupling nut 42 with upper and lower notch sets rotatably linked through a double keyed coupling bushing 43 to the keyed coupling lug on the upper portion of the merchandise wheel.

In accordance with this drive shaft design, the drive shaft assembly transmits rotational force from a crank handle to the lower merchandise wheel 32, and to the upper merchandise wheel 27 for dispensing merchandise stored in the container 11 onto the wire form track 16 for discharge through the chute 37. Therefore, rotation of the crank handle 20 rotates the lower merchandise wheel, which is imparted to the drive shaft that synchronizingly links the lower and upper merchandise wheel for controlled dispensing of merchandise from said storage globe.

Moving now to the details of the serpentine track 16, it is illustrated as a wire form structure, interposed between the upper and lower hoppers and comprises a plurality of segments directing the merchandise in a roller coaster-like path featuring many different directions as it guides and merchandise from the discharge aperture of the upper hopper to the channel 34 formed in the deflector 33. The track 16, which as illustrated is unitary and static, is dimensioned for dispensing generally spherical merchandise the movement of which is gravity induced. The serpentine wire form track 16 is formed from distinct upper and lower sections joined by a vertical drop zone 44. Each of the upper and lower sections incorporate, multiple vertically disposed layers and a plurality of differently angled segments where at least one segment comprises a straight section and another segment comprises a hairpin turn. Thus, the spherical merchandise M rolls along the serpentine course defined by the upper section, drops through the vertical drop zone 44 and continues to roll along the lower section of the wire form track 16.

Figure 5:
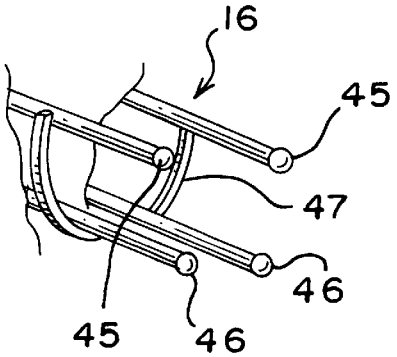
FIG. 5 is a perspective cutaway view of a section of the wire form track of the embodiment illustrated in FIG. 1.
Figure 4:
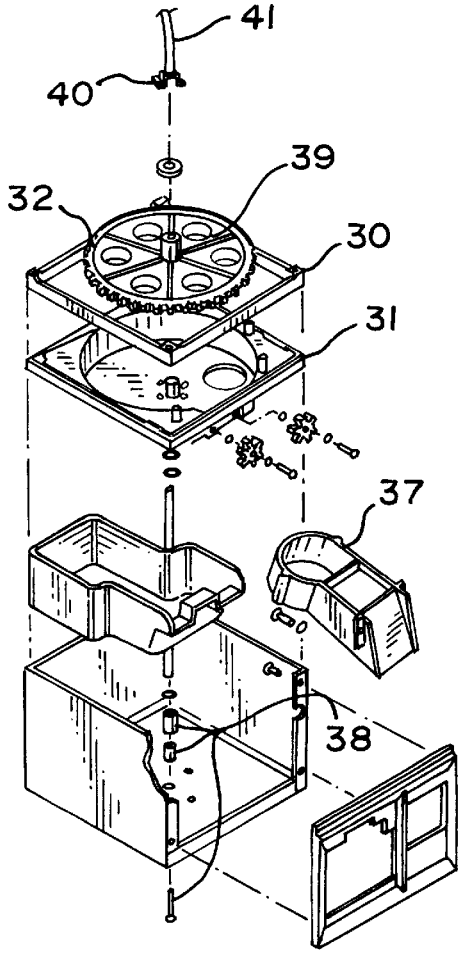
FIG. 4 is a partial exploded, assembly view detailing the base and coin receiving mechanism of the embodiment illustrated in FIG. 1.

In the illustrated embodiment, the track is formed of drawn chrome-plated or stainless steel wire (4 to 10 gage and preferably 6 to 9-gage). As illustrated in FIG. 5, the track forms a semicircular cylindrical element with an open top comprising an upper pair of rails 45, a lower pair of rails 46, and periodic, spaced semicircular support rings 47. The upper pair of rails are separated by about two inches and the lower rails by about ¾ of an inch. The depth of the semi-cylindrical track is about 1 inch. The upper and lower track sections feature has a vertical height, as measured from the bottom rails of approximately six inches and a length of approximately 54 inches for a 1:9 height to length ratio. The vertical height of the drop zone between the upper and lower segments is about one and a half inches. Although described as steel wire, the rails may be formed from any appropriate rigid, clean materials such as tempered glass, plastics, etc.

Alternate constructions of the merchandise guide path include multiple possible merchandise pathways, the least likely of which may trigger a bonus or the like, particularly if the machine incorporates electronic elements. While the embodiment has been described with a wire form track, it should be apparent to the skilled artisan, that any appropriate track forming medium that may be used to establish a serpentine raceway can be employed herein. For example, a tubular raceway such as that developed by using a clear plastic tube disposed in a plurality of angles and layers that circumscribe and transect the interior periphery of the intermediate chamber. Other adjuncts may be employed to generate irregular kinetic movement by dispensed items such as an intermediate elevator or conveyor for raising the spherical merchandise during the process of dispensing to provide a supplemental visual component enhancing the entertainment value of the vending process. The design variations are essentially unlimited so long as the design permits spherical merchandise to move from the globe to the dispensing chute.

With the present invention, the labor associated with insertion of multiple spiral sections into an intermediate housing in a machine of the type involved in converting the mechanism is minor requiring a minimum of time and a minimum degree of mechanical sophistication on the part of the user. Additionally, the costs associated with cleaning accumulated debris from the spiral member are essentially eliminated.

The above-described bulk vending machines are particularly useful in multiple machine/rack arrangements and are readily adaptable for a variety of potential applications including electronic vending.

Given the foregoing, variations and modifications to the invention should now be apparent to a person having ordinary skill in the art. These variations and modifications are intended to fall within the scope and spirit of the invention as defined by the following claims.

We claim:

1. A vending machine, comprising: a merchandise storage globe, a merchandise dispensing control element associated with said storage globe, an intermediate chamber in merchandise communication with said dispensing control element, a separate base including a dispensing opening and a rotatable manipulable crank, a drive shaft linkage extending through said intermediate chamber to said merchandise dispensing control element and drivingly connecting said manipulable crank with said merchandise dispensing control element for controlled dispensing of merchandise from said storage globe to said dispensing opening.

2. The vending machine of claim 1 where said first merchandise dispensing control element is disposed below the storage globe and said vending machine further comprises a second merchandise dispensing control element disposed between said base and said intermediate chamber, drivingly connected to said manipulable crank, and connected to said drive shaft linkage to synchronized with said first merchandise dispensing control element.

3. The vending machine of claim 2 where the merchandise dispensing control elements are hoppers containing rotatable merchandise wheels, the manipulable crank is rotatable and rotatably engaged with the second merchandise wheel which is engaged to said drive shaft which in turn is connected to said first merchandise wheel;

whereupon rotating said crank causes rotation of said second merchandise wheel, said drive shaft and said first merchandise wheel.

4. The vending machine of claim 1 where said merchandise dispensing control elements are dimensioned for dispensing generally spherical merchandise, said machine further comprising a merchandise guide path disposed in said intermediate chamber for establishing a merchandise path communicating said merchandise dispensing control element with said base.

5. The vending machine of claim 4 where said first merchandise dispensing control element is disposed below the storage globe and said vending machine further comprises a second merchandise dispensing control element disposed between said base and said intermediate chamber, drivingly connected to said manipulable crank, and connected to said drive shaft linkage to synchronized with said first merchandise dispensing control element.

6. The vending machine of claim 4 where said guide path is a serpentine wire form track permitting gravity induced movement of merchandise from the first dispensing control element to the base.

7. The vending machine of claim 4 where said guide path is a serpentine wire form track forming multiple vertically disposed layers within said intermediate portion in a manner to cause the spherical merchandise to roll along the wire form track.

8. The vending machine of claim 7 where said wire form track defines a plurality of differently angled segments.

9. The vending machine of claim 8 where at least one segments comprises a vertical channel and another segment comprises a hairpin turn.

10. The vending machine of claim 4 where said guide path is a serpentine tubular raceway forming multiple vertically disposed layers within said intermediate portion in a manner to cause the spherical merchandise to roll through the tube by gravitational force.

11. The vending machine of claim 4 where said guide path defines a static, serpentine pathway disposed about said drive shaft.

12. The method of making a vending machine according to claim 1 including the step of securing the merchandise control dispensing element with the merchandise storage globe.

13. The method of using a vending machine according to claim 1 including the step of rotating the manipulable crank to dispense merchandise.

14. A machine for dispensing generally spherical articles, comprising:

means for storing a plurality of articles where the articles have a generally spherical outer surface, said means for storing including a generally open bottom;

means for controlled distribution of articles from the open bottom of the means for storing, said means for distributing selectively dispensing articles;

an intermediate chamber below said means for storing, said intermediate chamber defining a guide path for articles from said means for controlled distribution of articles; and a base means for supporting said means for storing, said means for controlled distribution, and said intermediate chamber, said base means having a bottom wall and side walls, said top accommodating a selective operating assembly mechanically linked to said means for controlled distribution, and an article dispensing opening being located on said base, a coin actuation control means for actuating the selective operation of said distributing means, said control means being located in said base.

15. The dispensing machine according to claim 14 where said means for distributing is a multi-chambered, molded plastic wheel having a diameter corresponding to the open bottom of said means for storing and rotatably mounted relative thereto for dispensing one article at a time.

16. The dispensing machine according to claim 14 where said means for storing a plurality of articles comprises a hollow globe having an opening formed at its top and a lid corresponding in size to the opening where the lid is securable thereto to seal the opening.

17. The vending machine of claim 14 where said guide path is a serpentine wire form track forming multiple vertically disposed layers within said intermediate portion in a manner to cause the spherical merchandise to roll along the wire form track.

18. The vending machine of claim 17 where said wire form track defines a plurality of differently angled segments.

19. The vending machine of claim 18 where at least one segments comprises a vertical channel and another segment comprises a hairpin turn.

20. The vending machine of claim 18 where the selective operating assembly mechanically linked to said means for controlled distribution is a crank rod rotatably journaled about a compression rod extending between the base and the means for storage, said crank rod being rotatable able to impart rotational force from the selective operating assembly to the means for controlled distribution.

21. A dispensing machine, comprising:

a) a base;

b) a storage container for storing packets for dispensing, set on and above said base;

c) a track element defining an irregular serpentine pathway disposed between said base and said storage container;

d) a rotatable distributing member disposed between said base and said track element, said rotatable distributing element being operative to select a discrete packet for distribution quantity of merchandise to be dispensed upon operation of said machine;

e) a dispensing passage for communicating said discrete package from said track element to an opening disposed in said base; and f) a crank element operatively engaged with said rotatable distributing member to rotate said member and dispense a packet from the storage container to the serpentine track element.

22. The dispensing machine of claim 21 where the track element is a tubular raceway.

23. The dispensing machine of claim 22 where the track element is a unitary, wire form.

24. The dispensing machine of claim 23 where the wire form track element is multi-layer.

25. The dispensing machine of claim 21 where the track element is static.

26. The dispensing machine of claim 21 where the serpentine track is a defined by a wire form structure comprised of rods.

27. The dispensing machine of claim 26 where the serpentine track is formed of metal rods establishing a half-tube.

28. The dispensing machine of claim 21 where the serpentine track is formed of a clear tube a diameter sufficient to permit passage of the packets.

29. The dispensing machine of claim 21 where the rotatable distributing member is a molded plastic merchandise wheel.

30. The dispensing machine of claim 21 where the packets are substantially spherical and clear.

31. The dispensing machine of claim 21 where the storage globe, intermediate chamber, and base, are discrete and separable.

32. The dispensing machine of claim 31 where merchandise dispensed from the storage container by the merchandise dispensing control element descends directly through the intermediate chamber to the dispensing opening.

33. A dispensing machine, comprising:

a) a base;

b) a storage container for storing packets for dispensing, set on and above said base;

c) a track element defining an irregular serpentine pathway between said base and said storage container where the serpentine track is a defined by a wire form structure comprised of rods where the rods are formed from an appropriately rigid material selected from the group consisting of metal, resinous polymers, and, glass;

d) a rotatable distributing member disposed between said base and said container for selecting a discrete packet for distribution quantity of merchandise to be dispensed upon operation of said machine;

e) a dispensing passage for communicating said discrete package to an opening disposed in said base; and f) a crank element operatively engaged with said rotatable distributing member to rotate said member and dispense a packet from the storage container to the serpentine track.

34. A dispensing machine, comprising:

a) a base;

b) a storage container for storing packets for dispensing, set on and above said base;

c) a track element defining an irregular serpentine pathway between said base and said storage container where the serpentine track is a defined by a wire form structure comprised of rods;

d) a rotatable distributing member disposed between said base and said container for selecting a discrete packet for distribution quantity of merchandise to be dispensed upon operation of said machine where the rotatable distributing member is a molded plastic merchandise wheel, where the rotatable distributing member is a first and second merchandise dispensing wheels respectively spaced above and below the serpentine track and which are rotatably connected, and where the packets are substantially spherical and clear;

e) a dispensing passage for communicating said discrete package to an opening disposed in said base; and f) a crank element operatively engaged with said rotatable distributing member to rotate said member and dispense a packet from the storage container to the serpentine track.

35. A vending machine, comprising: a merchandise storage globe, a merchandise dispensing control element associated with said storage globe, an intermediate chamber in merchandise communication with said dispensing control element a merchandise dispensing pathway disposed within said intermediate chamber, and in merchandise dispensing communication with a rotatable manipulable crank, a separate base including a dispensing opening, a drive linkage within said intermediate chamber, extending to said merchandise dispensing control element, and being connected with said manipulable crank whereupon actuation of said merchandise dispensing control element, merchandise is dispensed from said storage globe to said dispensing opening.

36. The vending machine of claim 35 where manipulable crank is rotatable and gearingly inter-engaged with said merchandise dispensing control element whereupon rotation of said crank imparts rotational movement to said merchandise dispensing control element.

37. The vending machine of claim 36 where the storage globe, intermediate chamber, and base, are discrete and separable.

38. The vending machine of claim 37 where merchandise dispensed from the storage container by the merchandise dispensing control element descends directly through the intermediate chamber to the dispensing opening.

39. A vending machine, comprising:

a merchandise storage globe;

means for dispensing merchandise associated with said storage globe;

an intermediate chamber in merchandise communication with said means for dispensing;

a base over which said intermediate chamber is disposed;

a merchandise conveyance means for communicating said merchandise between said merchandise storage globe through said intermediate chamber to said base;

crank means for rotating said means for dispensing, said crank means being indirectly connected to said means for dispensing and including linkage means located in said intermediate chamber for imparting rotation to said means for dispensing.

40. The vending machine of claim 39 where the track means is a serpentine wireform.

41. The vending machine of claim 40 where the wireform extends through the intermediate chamber forming an uninterrupted, continuous dispensing pathway from the means for dispensing to the base.

42. The vending machine of claim 41 further including a merchandise dispensing chute with a dispensing opening located in said base where said opening is covered by pivotable chute cover.

* * * * *